US006155855A

United States Patent [19]

Weil et al.

[11] Patent Number: 6,155,855

[45] Date of Patent: Dec. 5, 2000

[54] DEVICE FOR ACTUATING AT LEAST ONE SHUNT IN A CONNECTOR PARTICULARLY WITH A MOVABLE STIRRUP

[75] Inventors: Christophe Weil, Montigny le Bretonneux; Antoine Peron, Epernon, both of France

[73] Assignee: Framatome Connectors International, Courbervoie, France

[21] Appl. No.: 09/396,267

[22] Filed: Sep. 15, 1999

[30] Foreign Application Priority Data

Sep. 16, 1998 [FR] France ..... 98 11712

[51] Int. Cl.[7] ..... H01R 29/00; H01R 31/08

[52] U.S. Cl. ..... 439/189; 439/509; 439/512

[58] Field of Search ..... 439/188, 189, 439/507, 509, 512, 510, 513, 514, 515

[56] References Cited

U.S. PATENT DOCUMENTS

| | | | |
|---|---|---|---|
| 5,007,888 | 4/1991 | Goutiere | 439/189 |
| 5,556,301 | 9/1996 | Chishima et al. | 439/507 |
| 5,899,762 | 5/1999 | Ainceri | 439/157 |

FOREIGN PATENT DOCUMENTS

| | | |
|---|---|---|
| 0 625 809 A1 | 11/1994 | European Pat. Off. . |
| 0 678 942 A1 | 10/1995 | European Pat. Off. . |
| 0 696 093 A2 | 2/1996 | European Pat. Off. . |
| 0 902 506 A2 | 3/1999 | European Pat. Off. . |

*Primary Examiner*—Paula Bradley
*Assistant Examiner*—Edwin A. Leön
*Attorney, Agent, or Firm*—Perman & Green, LLP

[57] ABSTRACT

The object of the invention is an actuating device for at least one shunt (30) in a connector comprising a base and a plug with at least one pair of contacts (28) short-circuited by the contacts of said shunt.

To this end, it comprises actuating means (24) of which a movable portion (90) is adapted to take:

a first position immediately adjacent each contact of each shunt when the contacts of the base and of the plug are electrically connected and partially mechanically connected, and a second position in which at least one of the contacts of each shunt is displaced to short-circuit said contacts when they are integrelly mechanically connected.

6 Claims, 7 Drawing Sheets

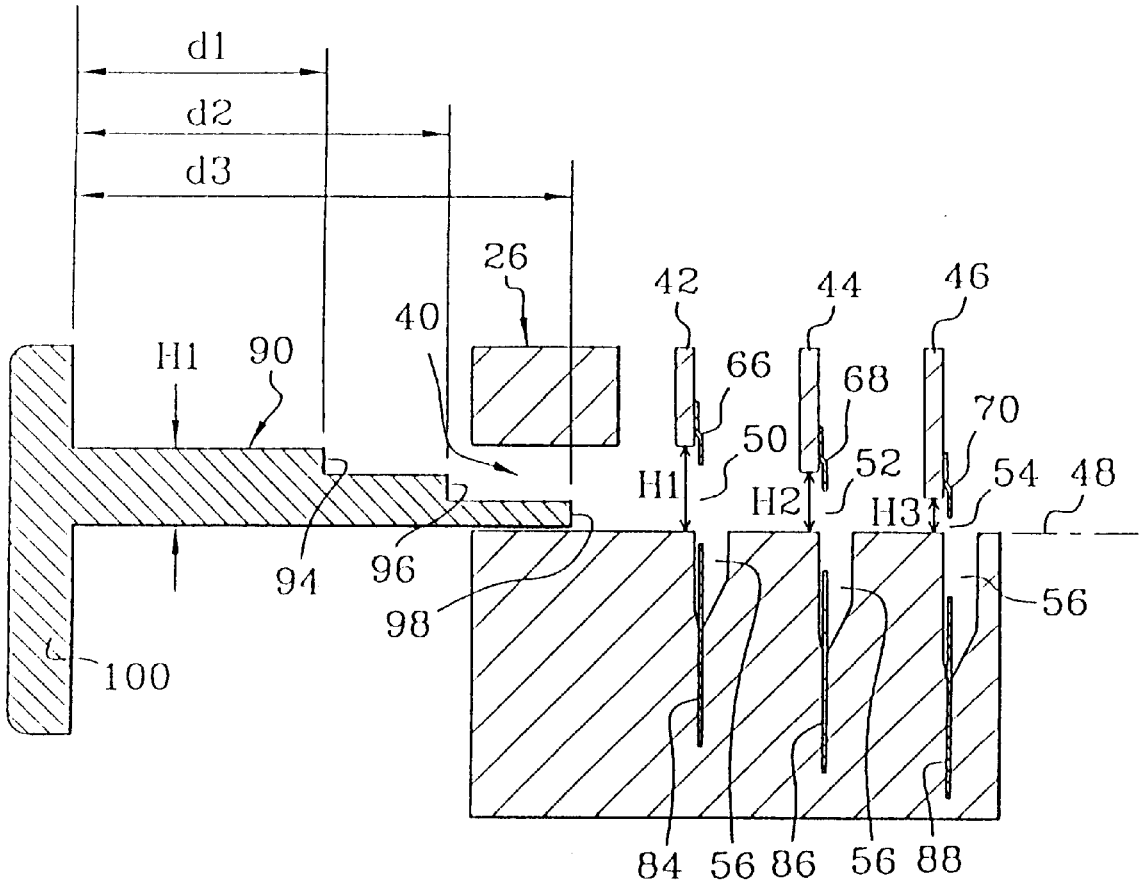
FIG.6A
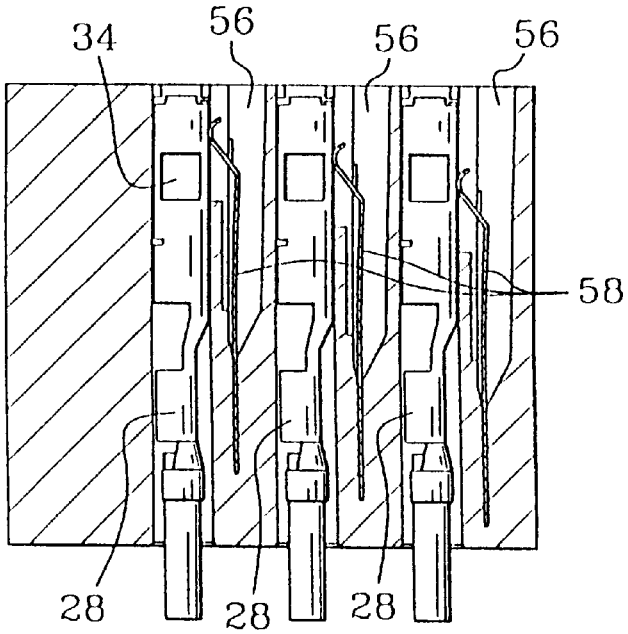

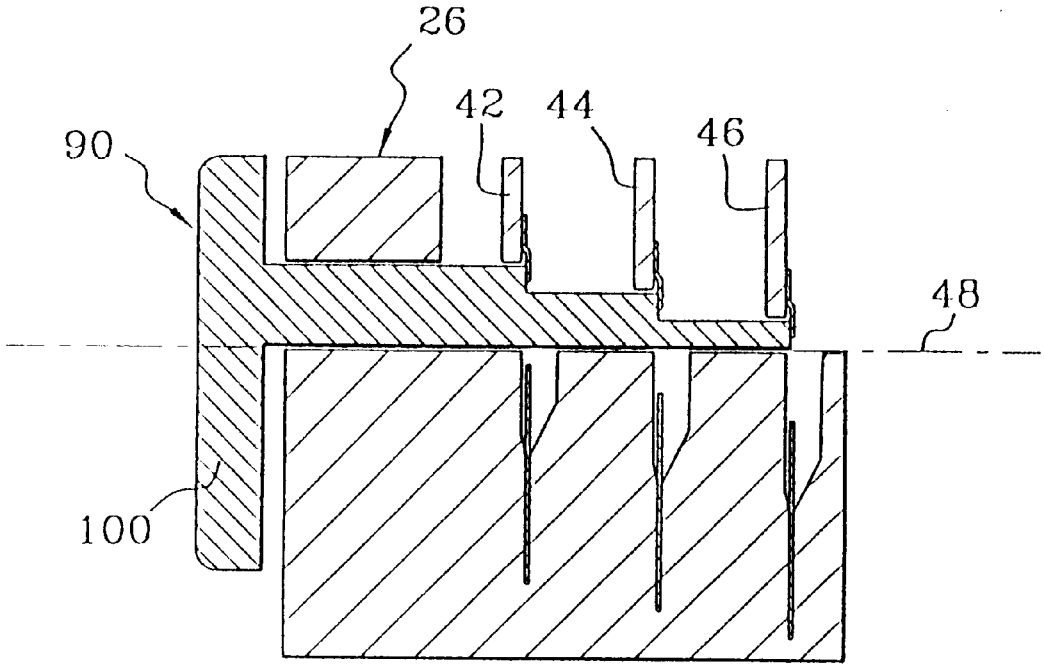
FIG.6B
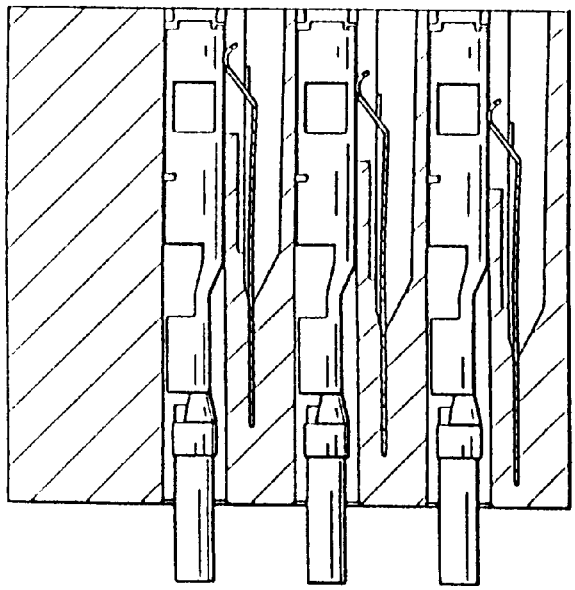

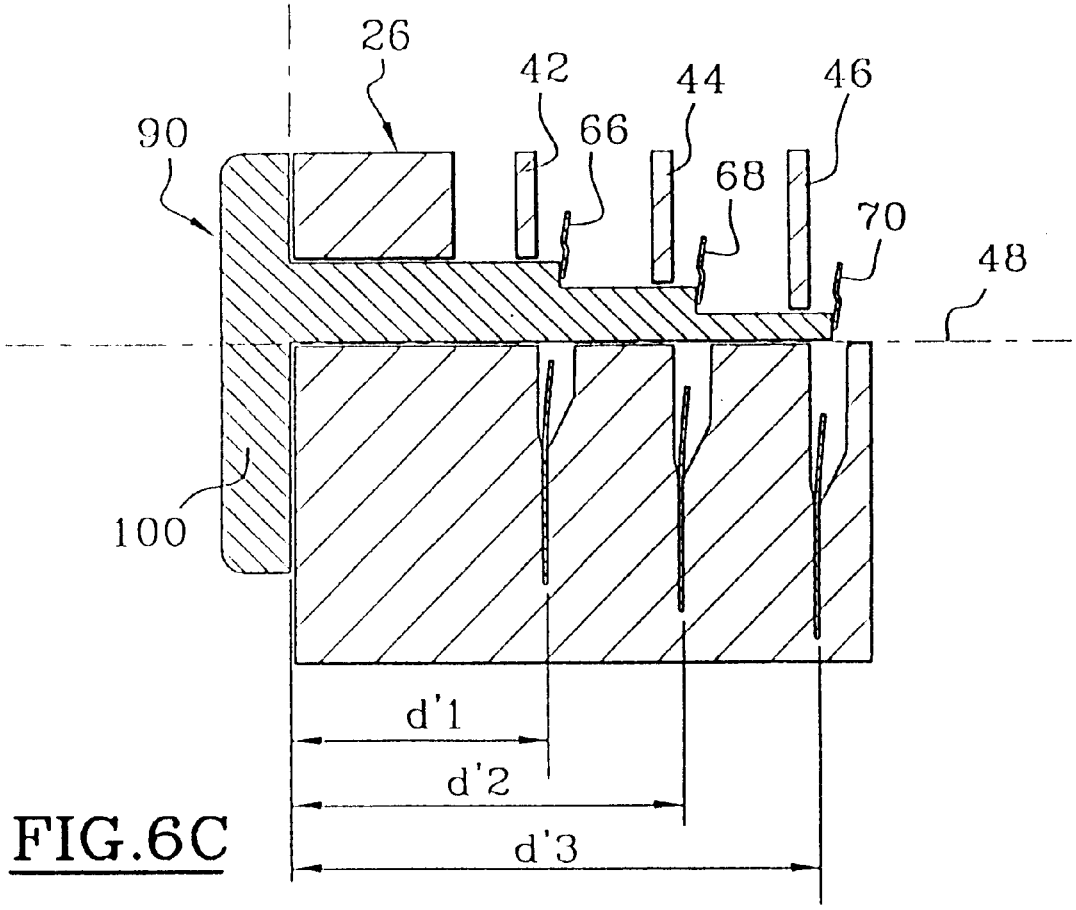
FIG.6C
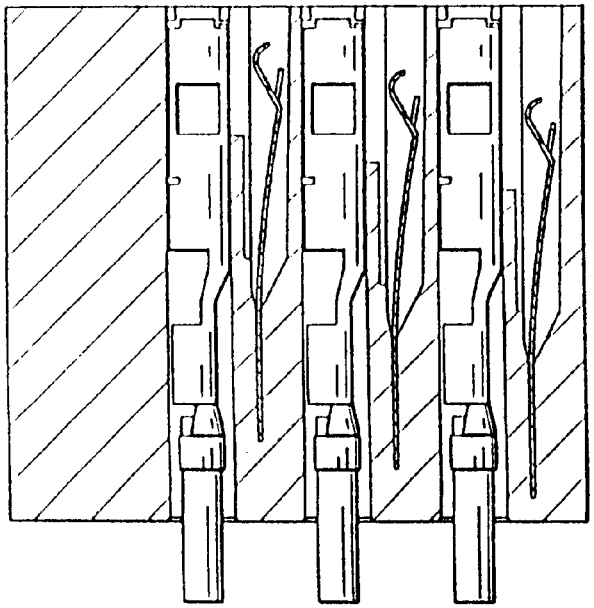

DEVICE FOR ACTUATING AT LEAST ONE SHUNT IN A CONNECTOR PARTICULARLY WITH A MOVABLE STIRRUP

BACKGROUND OF THE INVENTION

1. Field of the Invention

The present invention relates to a device for actuating at least one shunt particularly in a connector with a movable stirrup, more particularly adapted for mounting release for a safety airbag.

2. Description of the Invention

There are known connectors with a slide, particularly the described in the patent EP-A-625,809, in the name of the present applicaint, whose principal elements are shown in FIGS. 1 and 2 as "prior art". Such a connector comprises a base 10 and a plug 12 as well as a slide 14 of U shape. The plug is provided to receive a layer of contacts 16 of flat plates, such as shown in FIG. 2, and the base is provided to receive for example a block 18 comprising contacts.

The slide and the plug comprise means coacting to effect the insertion of the plug in response to movement of the slide in the direction of the arrow F, and vice versa.

The means comprise two pairs of lugs 20, disposed laterally on the plug, as well as two pairs of grooves 22 of suitable profile provided in each of the sidewalls of the slide.

Such a connector is interesting in the sense that the positioning of the blades relative to the contacts carried by the base is excellent and the enclosure of the different blades is simultaneous. In this case, there remains a problem, that arises for example in the case of triggering products controlled as safety airbags or pretensions for seat belts. Thus, such contacts are in short circuit when the corresponding connectors are not coupled, but it is necessary to overcome the action of these short-circuiting shunts immediately after connection and this in a reliable manner.

BRIEF SUMMARY OF THE INVENTION

To this end, according to the invention, the actuating device is applied to at least one shunt in a connector comprising a base and a plug with at least one pair of contacts short-circuited by said shunt contacts, and characterized in that it comprises actuating means of which a movable portion is adapted to take:

- a first position immediately adjacent each contact of each shunt when the contacts of the base and of the plug are connected electrically and partially connected mechanically, and
- a second position in which at least one of the contacts of each shunt is displaced to put out of short-circuit said contacts when they are integrally mechanically connected.

More particularly, the base comprises a block receiving each shunt and provided with a channel of complementary profile to that of the movable portion of the actuating means.

According to one characteristic of the invention, each movabable portion of the actuating means is an actuating finger movable in translation in the channel, this finger comprising at least one button adapted to bear against at least one of the contacts of each shunt.

Each shunt comprises specifically an active wing bearing a contact, this wing being adapted to receive in bearing relation a button provided on the actuating finger.

In the case of several shunts, the active wings are offset height-wise and the actuating finger comprises a series of corresponding buttons, also offset height-wise.

According to a preferred arrangement, the contacts of the base are of the cage type, the contacts of the plug are of the flat blade type and the contacts of each shunt are of the flexible blade type.

In the retained manner of use, the movable portion of the actuating means is secured to a stirrup for manipulating and locking the plug in the base.

BRIEF DESCRIPTION OF THE DRAWINGS

The invention will now be described with respect to the accompanying drawings which show an embodiment, which is non-limiting, the different figures showing.

DETAILED DESCRIPTION OF THE INVENTION

For ease of understanding, the present device is shown in connection with a connector with an automatic encasing slide such as that of the prior art mentioned above, because it is particularly well-adapted to this type of connector, but it may of course be applied to any connector with manual encasing with or without locking by the slide.

Figure 1:
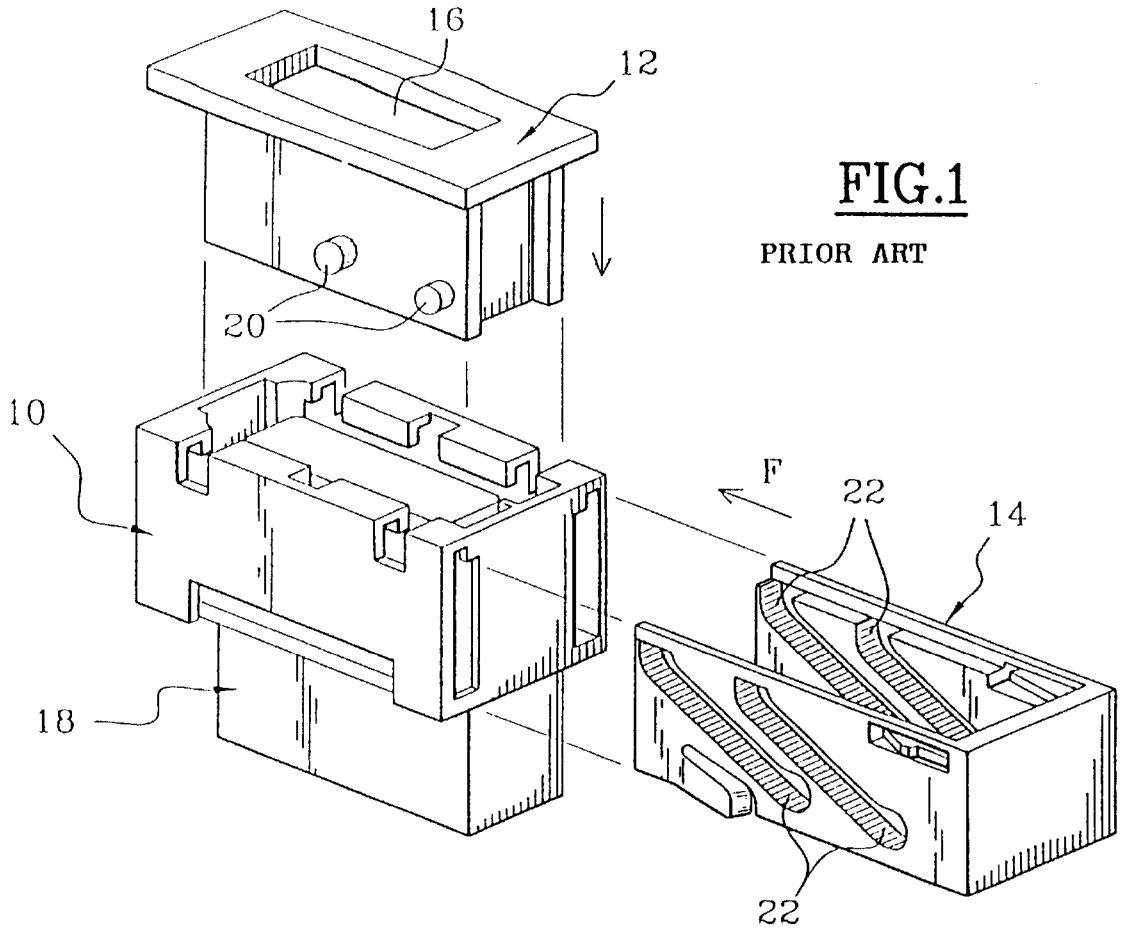
FIG.1 PRIOR ART
FIGS. 1 and 2, two perspective views of a connector with a slide of the prior art, FIG. 3, an exploded fragmentary perspective view of a slide and assembly of the actuating device according to the present invention, FIG. 4, a detailed perspective view, partially broken away, of the block carrying the contacts according to the device of the invention, FIG. 5, a detailed view of the shunts and the actuating means, FIGS. 6A, 6B and 6C, an operating synopsis of the device according to the invention.
Figure 2:
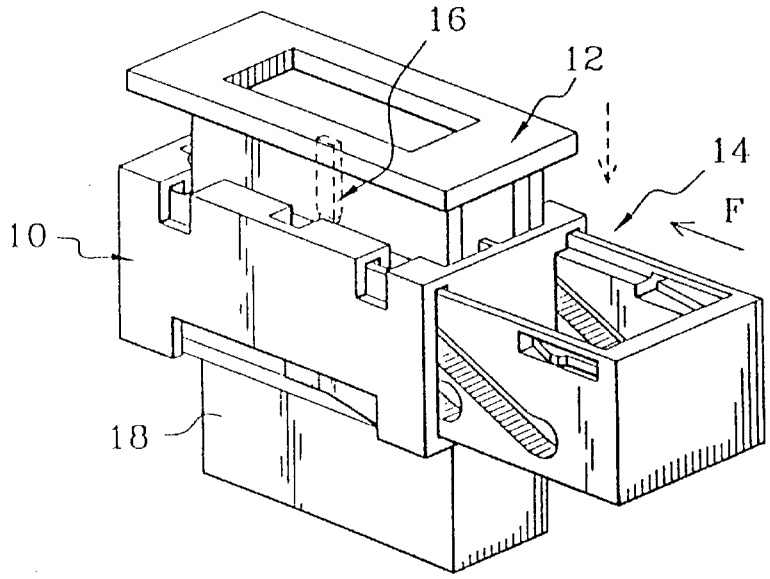
FIG.2 PRIOR ART
Figure 3:
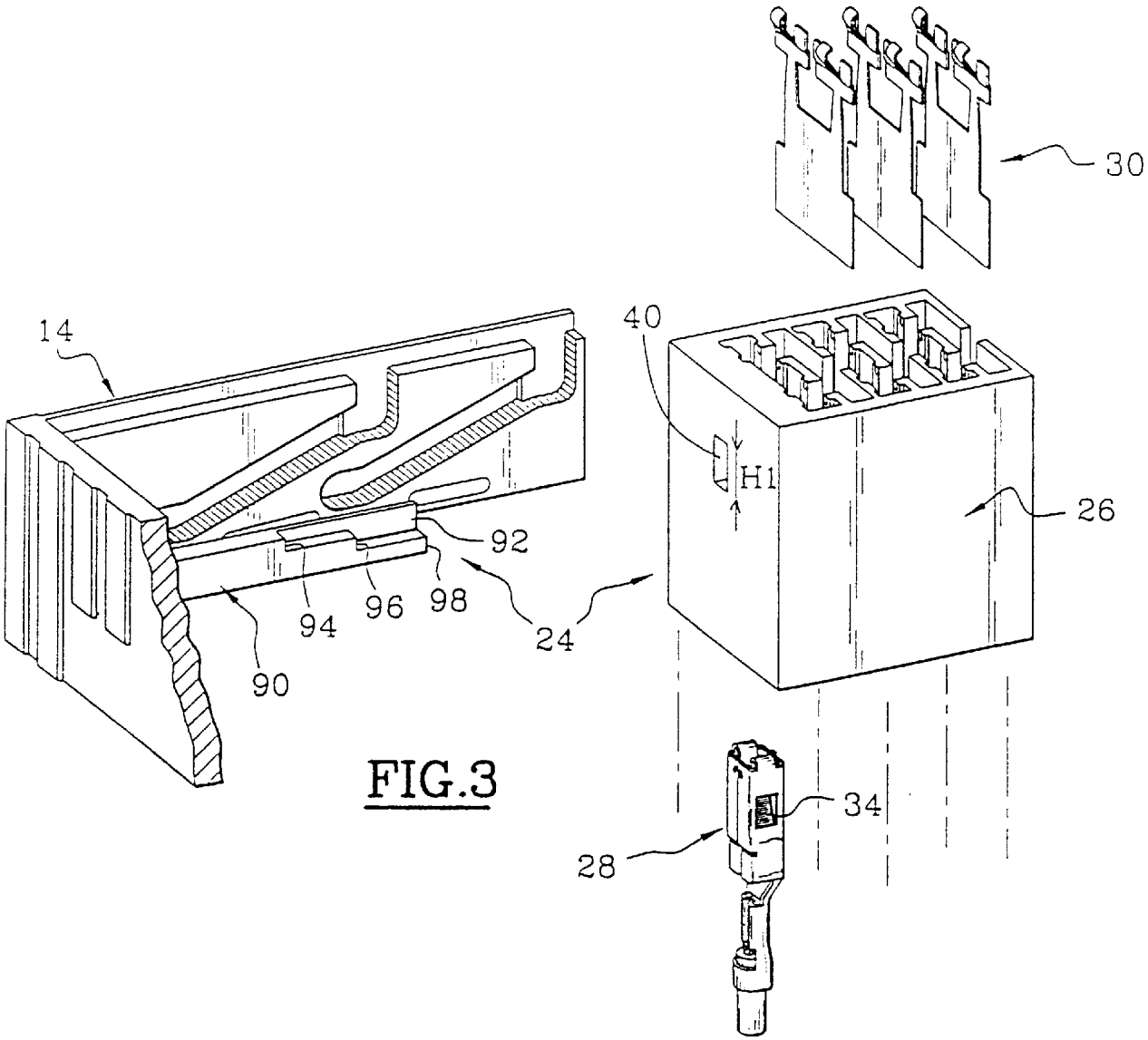

In FIG. 3, there is shown at 24, the actuating means of the actuating device according to the invention.

These actuating means comprise a block 26 for receiving contacts 28, of the cage type in the illustrated embodiment. In this block are inserted shunts 30.

Figure 4:
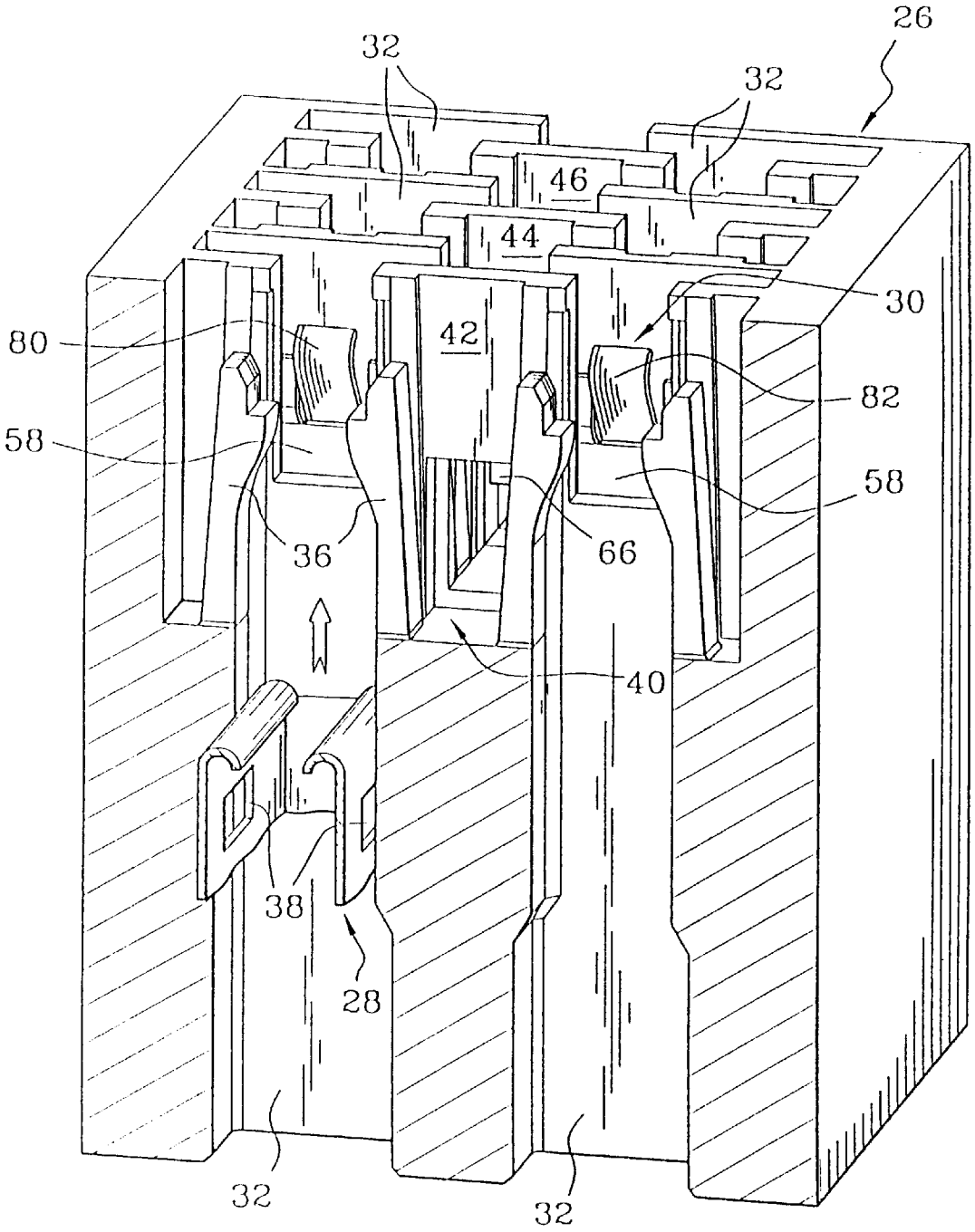

This block is shown in detail in FIG. 4. It comprises a series of first recesses 32, which are twinned, which each receive a pair of contacts 28, in the number of three pairs in the particular embodiment. Each recess is provided with individual means 34 for immobilizing in translation each contact, known per se, in this instance a :air of resilient fingers 36 formed by molding with the block and provided to coact with two windows 38 provided in the side surfaces of each contact 28.

These recesses 32 are distributed on opposite sides of a central passageway 40, provided in the block. This passageway is delimited by transverse dividers 42, 44 and 46, which are prolonged laterally, as is also seen in the synopsis of FIGS. 6A, 6B and 6C. These dividers are offset height-wise relative to a same guideline 48, which frees the passageways 50, 52 and 54, respectively of heights H1, H2 and H3.

The block 26 comprises a series of second recesses 56, which receive the shunts 30, each second recess being juxtaposed with a first twinned recess 32.

Figure 5:
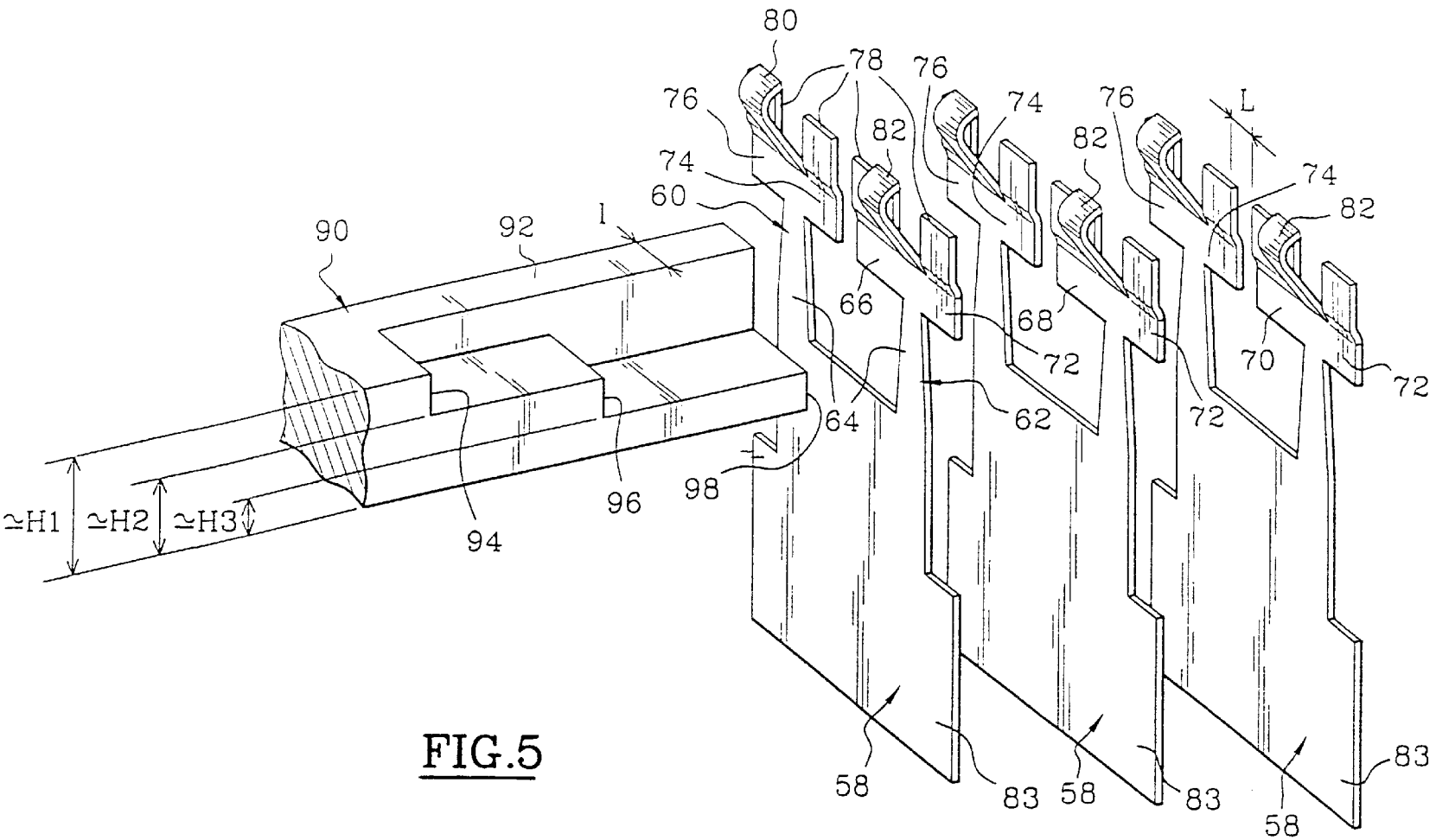

The shunts are present in the form of plates 58 with two branches 60 and 62, one branch 60 being passive and the other branch 62 being active, as shown in detail in FIG. 5.

Each branch has the shape of an T-beam with an identical foot 64 and different wings:

the active branch 62 has an internal active wing 66, 68 and 70, on the passageway side, of dimensions such that it projects into said passageway and an external wing 72 of dimensions simply adapted to the internal space available in the block, and the passive branch 60 has a passive internal wing 74, on the passageway side, such that it does not project into said passageway and an external wing 76 of dimensions simply adapted to the internal space available within the block.

Each of the passive wings 7,4 and active wings 66, 68, 70, comprises two bearing tongues 78 with identical pre-stress and one and the other of these wings carries respectively a contact 80, 82 with a flexibile blade.

The base 83 of each blade is immobilized in a slot 84, 86 and 88 which is nothing else that the reduced prolongation of each second recess 56, FIG. 6A. It will be noted that these slots have a different depth to permit, with identical plates, arranging these plates at different heights. These different heights as a result induce arrangement of the active wings 66, 68, 70 of each of the plates at different heights, in correlation with the variations of height H1, H2 and H3 of the dividers 42, 44 and 46.

These actuating means comprise, in addition to the block 26 for reception of the contacts 28, an actuating finger 90. This finger is mounted as particularly shown in FIG. 3 in which it is secured to the stirrup 14 in the use adapted to illustrate the actuating device according to the invention.

This finger 90 has a particular profile adapted to permit it to slide in the channel 40 provided in the block 26.

Moreover, this finger carries a so-called guide rib 92, of a height H1, disposed on the left side of said finger looking in the direction of introduction. The width I of this rib is less than the width L which separates the end of the active wing 66, 68 or 70, on the inner side and the left wall of the channel 40, looking in the direction of introduction.

This finger has stair-stepped cutouts which provide pushbuttons 94, 96 and 98. These pushbuttons have a height H1, H2 and H3, with the gap to slide, measured along whole height, lengths d1, d2 and d3, measured from the abutment 100 of maximum introduction of this finger. These lengths have values greater than those d'1, d'2 and d'3 which separate the bearing plane of the abutment 100 on the block and the active wings 66, 68 and 70, as shown in FIG. 6C, of a given spacing value.

The device according to the present invention will now be described without regard to particular figures.

The contacts 28 with cages are introduced into their respective recesses 32 whilst the base shown comprises three pairs of contacts. These contacts are immobilized in these recesses by coaction of the resilient fingers 36 with the windows 38.

The plates 58 of the shunts 30 are introduced into their recesses until the base 83 comes into abutment with the bottom of the slots 84, 86 and 88. These plates are then offset heightwise as shown in FIG. 6. In this configuration the contacts 80, 82 with flexible blades come into bearing against the contacts 28 with cages and hence into electrical connection with these same contacts through the suitable cutouts, provided in the transverse dividers 42, 44 and 46.

The tongues 78 bear on the lateral prolongations of these transverse dividers 42, 44 and 46.

This is particularly well shown in FIG. 6.

The plug 12 provided with its blades is positioned in the base such that the blades will be substantially facing the contacts 28 with a cage and the stirrup 14 is pre-encased in the base.

During movement of the stirrup 14 in the direction of the arrow F, the plug is inserted into the base thanks to the ramps of the stirrup which coact with the pairs of lugs 20.

Simultaneously with the translatory movement of the stirrup, the actuating finger 90 with which it is integral, enters the channel 40 as shown in FIG. 6A. Then, after sufficient insertion of the plug into the base, the blades penetrate the cage contacts, thereby ensuring the electrical connection, whilst the pushbuttons of the finger come into bearing against the active wings 66, 68 and 70. The mechanical connection remains incomplete.

At this stage, the contacts 80, 82 with flexible blades are still bearing against the contacts with cages whilst the contacts of each pair are in short circuit. This is step 6B.

The last step consists in pushing the stirrup 14 to complete its penetration and so that it comes into abutment whilst finger 90 is also abutment with it. The obtained arrangement is shown in FIG. 6C, in which the pushbuttons 94, 96 and 98 have given rise to the retraction of the active blades 66A, 68A and 70A thereby ensuring the retraction of the contacts 82 with flexible blades and hence the electrical disconnection whilst the cage contacts of each pair are short-circuited and the blades are mechanically inserted, in an integral manner, into the cage contacts.

The actuating device according to the present invention permits connecting two elements whilst maintaining them in short circuit during connection and by ensuring the short-circuiting upon the electrical connection of the two elements.

Modifications can be conceived of, which remain within the scope of the invention, by modifying the shape of the actuating finger and rendering it symmetrical to act two active blades of each plate, which thus lend themselves to be modified, this modified finger comprising a central guide throat. In this case, the two contacts of the short circuit are omitted.

In the case in which the connector is of the manual insertion type without a stirrup, the manipulation of the actuating finger is manual and takes place after electrical connection of the contacts of the base an of the plug, preferably after integral mechanical insertion.

What is claimed is:

1. Actuating device having at least one shunt (30) in a connector comprising a base (10) and a plug (12) with at least one pair of contacts (28) short-circuited by contacts (80, 82) of said shunt, characterized in that said device comprises actuating means (24) of which a movable portion (90) is adapted to take:

a first position immediately adjacent each contact (80, 82) of each shunt when the contacts (28, 16) of the base and of the plug are electrically connected and partially mechanically connected, and a second position in which at least one (82) of the contacts of each shunt (30) is displaced to short-circuit the contacts (28) of the base when they are integrally mechanically connected, said movable portion being secured to a stirrup (14) for manipulating and locking said plug in said base and characterized in that the movable portion(90) of the actuating finger movable in translation in a channel (40), this finger (90) comprising at least one pushbutton (94, 96, 98) adapted to bear against at least one (82) of the contacts of each shunt.

2. Actuating device according to claim 1, characterized in that the base (10) comprises a block (26) receiving each shunt (30) and provided with a channel (40) of a profile complementary to that of the movable portion (90) of the actuating means (24).

3. Actuating device according to claim 1, characterized in that the contacts (28) of the base (10) are of the cage type, the contacts (16) of the plug (12) are of the flat blade type and the contacts (80, 82) of each shunt (30) are of the flexible blade type.

4. Actuating device according to claim 1, characterized in that each shunt (30) comprises an active blade (66, 68, 70) carrying a contact (82), which blade is adapted to receive in bearing relationship a pushbutton (94, 96, 98) provided on the actuating finger (90).

5. Actuating device according to claim 4, characterized in that, in the case of several shunts, the active wings are height-wise offset (H1, H2, H3) and the actuating finger comprises a corresponding series of pushbuttons (94, 96, 98) also height-wise offset.

6. Actuating device having at least one shunt (30) in a connector comprising a base (10) and a plug (12) with at least one pair of contacts (28) short-circuited by contacts (80, 82) of said shunt, characterized in that said device comprises actuating means (24) of which a movable portion (90) is adapted to take:

a first position immediately adjacent each contact (80, 82) of each shunt when the contacts (28, 16) of the base and of the plug are electrically connected and partially mechanically connected, and a second position in which at least one (82) of the contacts of each shunt (30) is displaced to short-circuit the contacts (28) of the base when they are integrally mechanically connected, said movable portion being slidably secured to a support surface (14) for manipulating and locking said plug in said base and characterized in that the movable portion (90) of the actuating means (24) is an actuating finger movable in translation in a channel (40), this finger (90) comprising at least one pushbutton (94, 96, 98) adapted to bear against at least one (82) of the contacts of each shunt.

* * * * *